US012076633B2

(12) United States Patent
Kawiya

(10) Patent No.: US 12,076,633 B2
(45) Date of Patent: Sep. 3, 2024

(54) GOLF GLOVE CONSTRUCTION

(71) Applicant: Acushnet Company, Fairhaven, MA (US)

(72) Inventor: Sakolwan Kawiya, Chonburi (TH)

(73) Assignee: Acushnet Company, Fairhaven, MA (US)

( * ) Notice: Subject to any disclaimer, the term of this patent is extended or adjusted under 35 U.S.C. 154(b) by 148 days.

(21) Appl. No.: 17/539,559

(22) Filed: Dec. 1, 2021

(65) Prior Publication Data

US 2022/0088464 A1 Mar. 24, 2022

Related U.S. Application Data

(63) Continuation-in-part of application No. 16/751,313, filed on Jan. 24, 2020, now abandoned.

(51) Int. Cl.

| | |
|---|---|
| ***A63B 71/14*** | (2006.01) |
| ***A41D 19/00*** | (2006.01) |
| ***A41D 19/015*** | (2006.01) |
| *A41D 19/04* | (2006.01) |

(52) U.S. Cl.

CPC ..... *A63B 71/146* (2013.01); *A41D 19/0006* (2013.01); *A41D 19/01547* (2013.01); *A41D 19/04* (2013.01); *A41D 2300/50* (2013.01); *A63B 2209/00* (2013.01)

(58) Field of Classification Search

CPC ..... A63B 71/146; A41D 19/0006; A41D 19/01547

See application file for complete search history.

(56) References Cited

U.S. PATENT DOCUMENTS

| | | | | |
|---|---|---|---|---|
| 1,584,304 | A | 5/1926 | Kennedy | |
| 5,893,172 | A * | 4/1999 | Haynes | A63B 71/146 2/167 |
| 7,882,571 | B2 | 2/2011 | Robba et al. | |
| 8,205,269 | B2 | 6/2012 | Anderson | |
| 8,397,313 | B2 | 3/2013 | Bevier | |
| 8,453,266 | B2 | 6/2013 | Bevier et al. | |
| 9,302,171 | B1 * | 4/2016 | Lacono | A41D 19/01547 |
| 2008/0201822 | A1 | 8/2008 | Oshima | |
| 2009/0313742 | A1 * | 12/2009 | Smeltzer | A41D 27/28 2/167 |
| 2012/0030856 | A1 | 2/2012 | Bevier | |

(Continued)

*Primary Examiner* — Tajash D Patel

(74) *Attorney, Agent, or Firm* — Kristin D. Wheeler

(57) ABSTRACT

Golf gloves having a modified construction for ease of manufacture and improved flexibility, comfort and fit are provided. In one preferred embodiment, the glove contains seamless gussets provided between finger stalls. Preferably, the seamless gussets are made using a single piece of material sewn between the finger stalls of the glove. Additionally, the golf glove construction may include a palm piece that forms the palm of the golf glove, including the palm side of the finger stalls and also wraps around the finger stall for the index finger of the golfer to for the back of the index finger stall too. The golf glove construction may also feature a back piece that covers the back of the hand except for the finger stall for the index finger and an elastic knuckle region. A bridge may connect a back portion with the back finger portions of the back piece to reduce over stretching of an elastic knuckle region of the glove.

17 Claims, 10 Drawing Sheets

(56) References Cited

U.S. PATENT DOCUMENTS

| | | | | |
|---|---|---|---|---|
| 2013/0041302 | A1 | 2/2013 | Williams | |
| 2013/0263354 | A1 | 10/2013 | Gibby | |
| 2013/0263356 | A1* | 10/2013 | Jones | A63B 71/148 2/163 |
| 2013/0276207 | A1* | 10/2013 | Curl | A63B 71/141 2/163 |
| 2014/0026281 | A1 | 1/2014 | Kleinert | |
| 2015/0026864 | A1* | 1/2015 | Bruce | A41D 19/0044 2/167 |
| 2016/0366958 | A1 | 12/2016 | Hochmuth | |
| 2019/0091548 | A1* | 3/2019 | Widdemer | A63B 71/146 |
| 2022/0218059 | A1* | 7/2022 | Weed | A41D 19/01547 |
| 2023/0310969 | A1* | 10/2023 | Lim | A41D 19/01564 2/161.2 |

* cited by examiner

GOLF GLOVE CONSTRUCTION

CROSS REFERENCE TO RELATED APPLICATIONS

This application is a continuation-in-part of co-pending, co-assigned U.S. patent application Ser. No. 16/751,313 filed on Jan. 24, 2020, the entire disclosure of which is hereby incorporated by reference herein.

BACKGROUND OF THE INVENTION

Field of the Invention

The present invention relates generally to golf gloves that fit tightly around a person's hand while also providing a comfortable feel. More particularly, the golf glove contains seamless gussets provided between the fingers. These seamless gussets provide improved comfort and ease of manufacturing.

Brief Review of the Related Art

Typically, golfers use at least one golf glove on their leading hand when playing golf. Most golfers use gloves to improve their grip of the golf glove relative to the bare hand, which often provides less grip especially when sweating or when club grips are wet. When a glove is used to provide a more secure grip, the golfer wearing the glove correspondingly has more control of the golf club, thus theoretically enabling improvement of their golf game. The glove can also provide some added protection from vibration and abrasion, although such protection is relatively minimized by the thinness of the glove material.

Both professional and amateur golfers are interested in gloves having good durability, flexibility and comfort. The durability of the glove is important, because golfers use a variety of grips on their clubs and constantly press the glove against the club grip. Different areas of the glove can become overly worn and even develop tears and rips after continuous use. Conventionally golf gloves have been formed of a very thin leather and/or synthetic material, that enables the user to feel the grip of the club through the glove. Common golf glove materials include leather, synthetic leather, spandex, blends with spandex, elastane, and other flexible and/or stretchable material. The material provides a smooth, wrinkle-free interface between the user's hand and the grip of the golf club.

Generally, the materials similar to and including leather provide better gripping properties but are less flexible, while the materials similar to and including spandex provide better flexibility but are more slippery, affecting grip and adhesion. Thus, golf glove design involves a balancing of such features as improving tackiness or adhesion to the golf glove grip, while also providing flexibility to the user's hand where desired, and maintaining a high degree of touch sensitivity enabling the user to feel the grip of the golf club in certain fingers during play. The interrelation between some of these features with each other can influence the final fit and performance of the golf glove.

In recent years, the comfort level of the glove also has become increasingly important. The glove should fit tightly around the golfer's hand so that he/she can maintain a good grip on the club, but, at the same time, it should be comfortable to wear. For example, removing seams that could be uncomfortable for the golfer may assist the fit, comfort and feel of golf glove during play. Additionally, removing seams may result in a streamlined manufacturing process decreasing the time and/or expense needed to manufacture a golf glove that is durable, flexible and comfortable for the golfer. As shown in FIG. 14, a prior art golf glove construction requires a seam 10 in the valley 12 of the gusset 14 between the finger stalls 16, 18 when connecting the front and back of each finger stall 16, 18 to the gusset 14 forming the side wall of each finger stall 16, 18. Seams such as these can increase discomfort when wearing and using the glove and increase manufacturing time and expense.

Thus, although some golf gloves have reduced or rearranged the seams on the golf glove, there is a continuing need for improved glove constructions having good durability, flexibility and fit as well as comfort and ease of manufacture. The present invention provides golf glove constructions having such properties as well as other advantageous features and benefits.

SUMMARY OF THE INVENTION

The present invention relates to golf gloves that can fit tightly on a wearer's hand and provide a comfortable feel. The glove contains seamless gussets between finger stalls and this improves comfort of the glove and improves the ease of manufacture. Furthermore, the glove has good overall durability, flexibility and fit.

More particularly, in one preferred embodiment, the glove of the present invention includes a body having a back layer and front layer and at least one gusset portion, the back layer and the front layer being joined together to define a cavity for receiving a wearer's hand. The body includes an open end for inserting the wearer's hand and a closed end having multiple finger stalls and a thumb stall for receiving fingers and thumb respectively of the wearer's hand. The at least one gusset portion extends continuously between at least a tip of one finger stall to a tip of an adjacent finger stall, thereby forming inner sides of the finger stalls by extending through a valley between the adjacent finger stalls such that the valley does not contain a seam.

More particularly, a method of manufacturing a golf glove is disclosed, comprising the steps of providing a front layer, the front layer forming a palm of the glove and front regions of a finger stall for each of a small, ring, middle and index fingers, providing a back layer, the back layer forming a dorsal side of the glove and back regions of a finger stall for each of the small, ring and middle fingers, and providing at least one gusset portion connecting the front layer and the back layer to form inner sides of the finger stalls for the small, ring, middle and index fingers. The at least one gusset portion extends continuously from at least a tip of one finger stall to a tip of an adjacent finger stall by extending continuously through a valley provided between the adjacent finger stalls.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION OF THE INVENTION

Referring to FIGS. 1-13, a left-handed golf glove 100 is shown. The Figures illustrate a left-handed glove, but it should be understood that the counterpart right-handed glove is a mirror image having the same structure with a different orientation and does not need not be described and illustrated separately. Moreover, although the glove will be described in this specification as primarily a golf glove, it should be understood the glove can be used in other end-use applications including, for example, baseball, football, racquetball, cycling, weight-training, gardening, work, construction, and the like in accordance with this invention. The golf gloves shown in FIGS. 1-13 are for illustration purposes only and should not be construed as limiting the scope of the invention.

Figure 1:
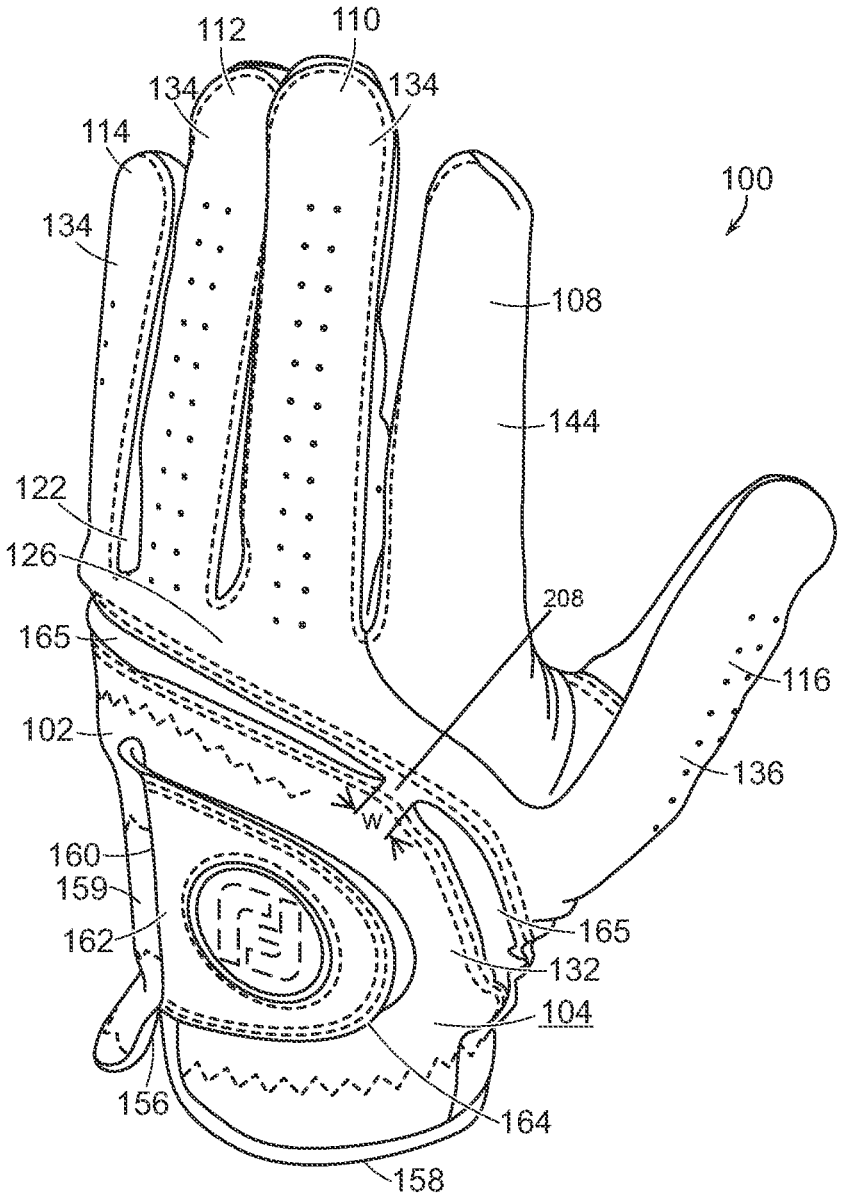
FIG. 1 is a back, perspective view of one embodiment of a golf glove of the present invention.
Figure 2:
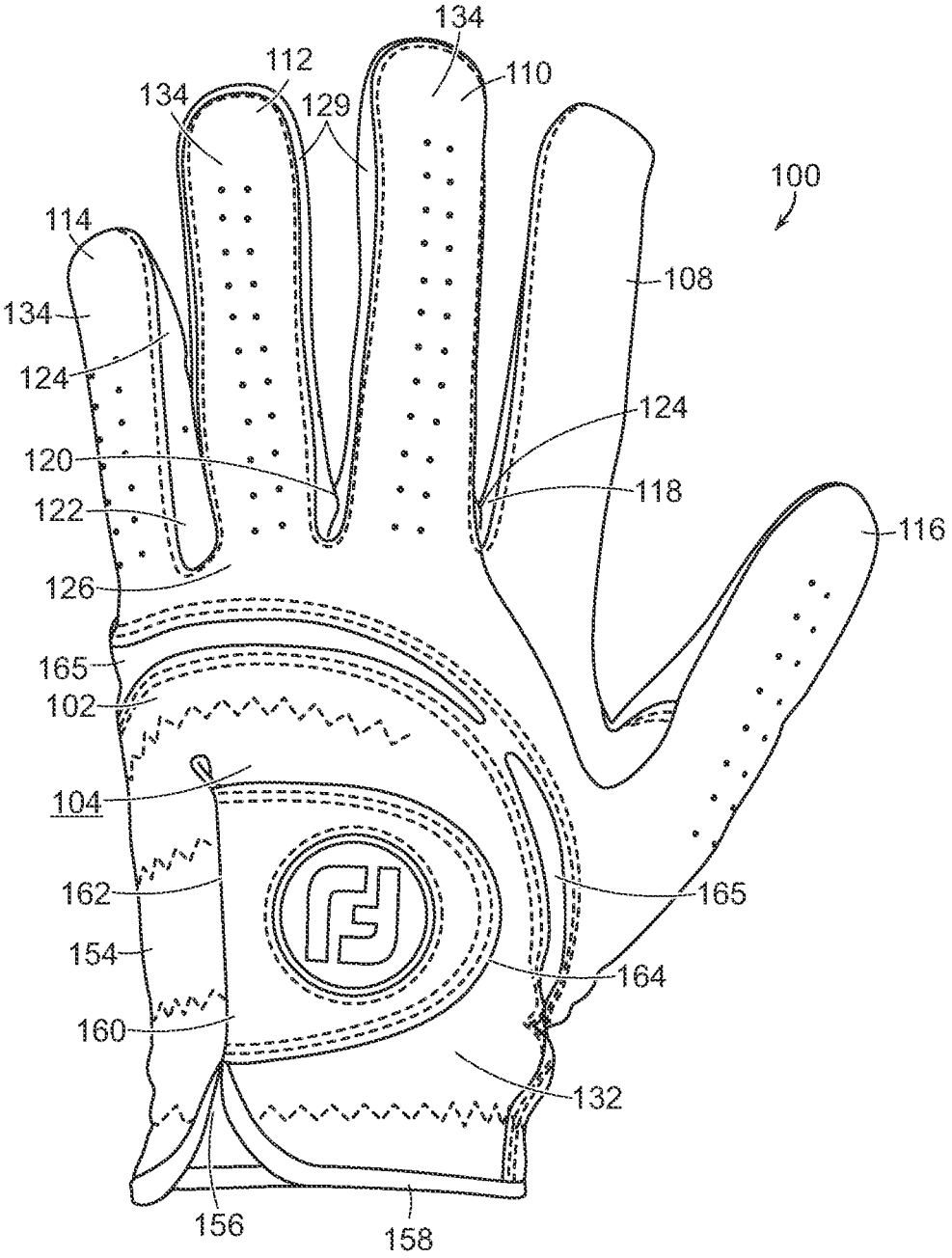
FIG. 2 is a back view of the glove shown in FIG. 1.
Figure 3:
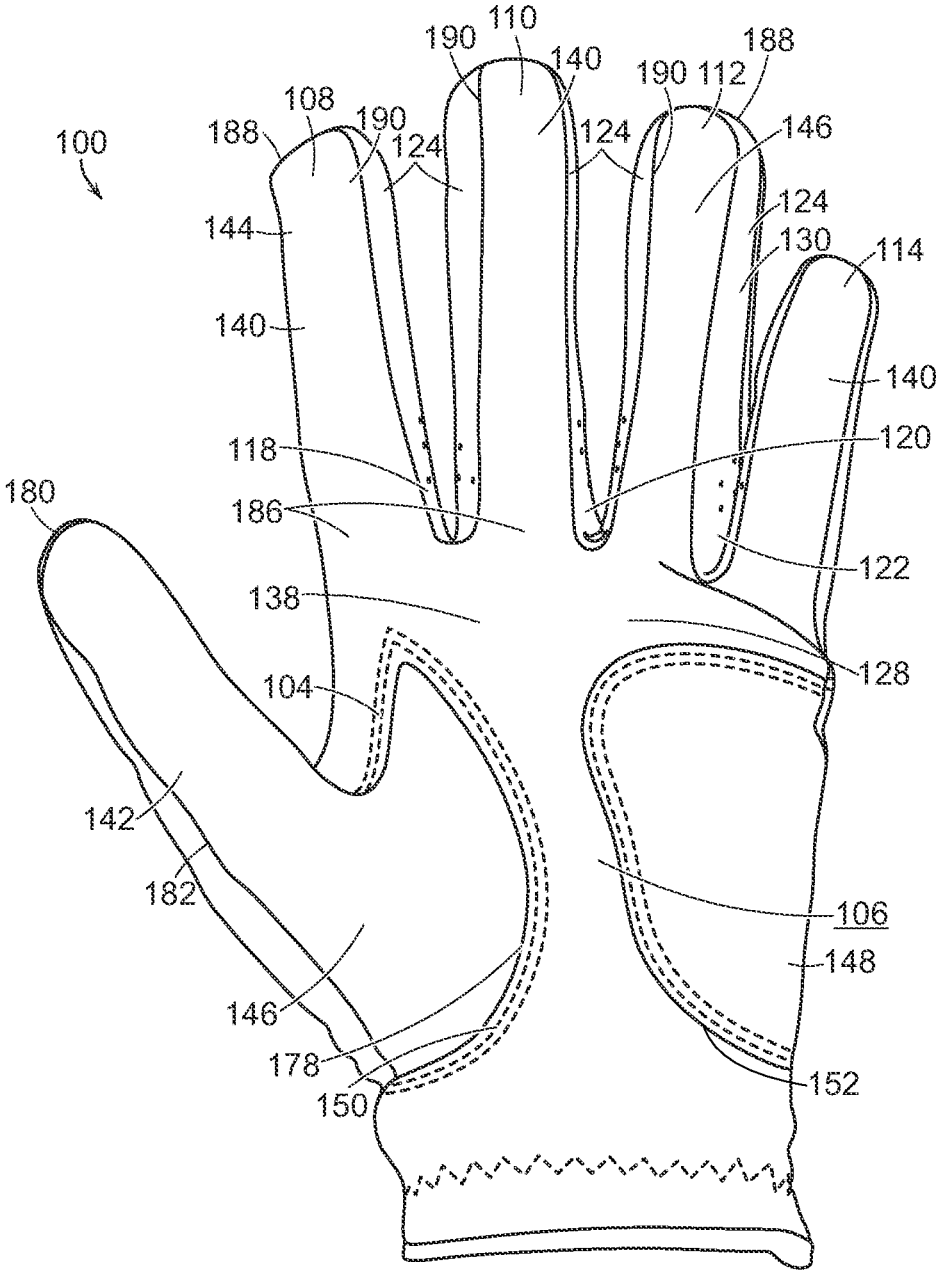
FIG. 3 is a front view of the glove shown in FIG. 1.

In FIGS. 1-2 a golf glove 100 is shown with a body 102 having a dorsal side 104 to cover the back of a person's hand (not shown) and FIG. 3 shows a palmar side 106 of the same glove 100 to cover the palm of a hand. The glove 100 also includes finger stalls 108, 110, 112 and 114 to receive fingers, respectively therein. A thumb stall 116 is provided to receive the thumb therein. Also provided in the web area of the glove 10 between the finger stalls 108, 110, 112 and 114 are gussets 118, 120, 122, respectively, wherein gussets 118, 120, 122 extend along the inner sides 124 of the stalls.

As shown in FIGS. 1-3, the golf glove 100 dorsal side 104 includes a back layer 126, the palmar side 106 includes a front layer 128, and the gussets 118, 120, 122 comprise at least one gusset portion 130. The at least back layer 126, front layer 128 and gusset portion 130 are joined together to define an interior cavity for receiving a person's hand. More particularly, the glove body 102 generally includes an open end for inserting the hand and a closed end having finger stalls 108, 110, 112, and 114 for receiving the fingers and a thumb stall 116 for receiving the thumb. In a preferred embodiment as shown, the back layer 126 further includes a back portion 132 and back finger portions 134 and a back thumb portion 136. The front layer 128 further includes a palm portion 138, front finger portions 140 and front thumb portion 142. As shown, front layer 128 has an index finger portion 144 that is made to wrap around the index finger stall 108 such that the back portion of the index finger stall 108 is formed from the front layer 128 and not the back layer 126, thus eliminating the seam on the outer side of the index finger stall 108. As shown, the gussets 118, 120, 122 are made from gusset portion 130 formed of a single piece of material and is connected to the back layer 126 and front layer 128 to form the finger stalls 108, 110, 112 and 114. The back layer 126, front layer 128 and gusset portion 130 are joined to each other by stitching or other suitable techniques such as welding, bonding, or adhesives. It will be appreciated that the back layer 126 and front layer 128 may each be formed of a single piece of material, or may be provided in any number of pieces of material and then joined together. As shown, the front layer 128 includes a thumb piece 146 and an outer palm piece 148. These are provided as separate pieces that are joined to the front layer 128 and back layer 126. Specifically, the thumb piece 146 is joined to the front and back layers 128, 126 at seams 150. Preferably, the outer palm piece 148 is provided on top of the front layer 128 for additional padding, although it will be appreciated that the outer palm piece 148 may be a single layer and connected at seams 152 to the edges of the front layer 128 and back layers 126.

Referring to FIG. 2, the dorsal side 104 having the back layer 126 of the glove 100 is shown. The back layer 126 includes a dorsal section 154 having a slit or opening 156 (shown in the closed position) that extends from the wrist edge 158 towards the finger stalls 108, 110, 112, 114 of the glove. The slit 156, when opened, allows a person to slip his/her hand into the glove more easily. The dorsal section 154 further includes a flap or strap 160 having a fixed-end portion 162 and free-end portion 164. The dorsal section 154 and/or flap 160 may be imprinted with a logo, tradename, symbol, or other mark as is customary with golf gloves. The wearer places one hand into the glove 100 and uses the other hand to grasp the flap 160 and pull it over the slit 156. Then, the flap 160 is fastened to the opposing dorsal section 154 of the glove to tighten and secure the glove on the wearer's hand. Preferably, hook-and-loop fasteners such as Velcro® fasteners are used to lock the flap 160 in place. More particularly, the flap 160 has exterior 166 and interior (not shown) surfaces. Tiny hook/loop fasteners are arranged on the interior surface of the flap 160 and complementary hook/loop fasteners are arranged on the opposing dorsal section (not shown) of the glove. When the flap 160 is pulled over the slit 156, it is releasably attached to the opposing dorsal side of the glove by mating the complementary hook/loop fasteners together. The wearer of the glove may release the flap 160 by simply pulling on it in an upward direction, and then his/her hand may be removed easily. It is recognized that other closure systems (for example, snap-on buttons, ties, buttons/button holes, buckles, elastics, and the like) may be used in addition to or in place of a hook/loop fastening system.

Preferably, the front layer 128 is formed primarily of a substantially inelastic material such as, for example, natural leather, synthetic leather, other non-woven materials, natural fabric, and synthetic fabric, among others. Suitable leather materials include, for example, sheepskin, deerskin, doeskin, steer hide, goatskin, and kangaroo skin, among others. In one preferred embodiment, leather produced from the skins of sheep having hair instead of wool (commonly referred to as "cabretta leather") is used to form the front layer 128. Suitable non-woven materials include, for example, nylon, nylon-acrylic, neoprene, or terrycloth, among others. Polyurethane-coated nylons may be used as the material for making the front layer 128 in one particular embodiment. It also is recognized that other thermoplastic materials can be used to form the front layer 128 in accordance with this invention. As discussed above, in one preferred embodiment, cabretta leather is used to form the front layer 128. This leather material, when used in the glove constructions of this invention, helps provide the glove with good wear-resistance and comfort. Suitable leathers are available from Pittards PLC, Sherborne Road, Yeovil, Somerset BA21 5BA, Great Britain. It will be appreciated that the additional thumb piece 146 or outer palm piece 148 may be formed of the same or different material as the front layer 128. It will also be appreciated that these pieces may have contrasting textures or colors in comparison to either/or the front layer 128 or back layer 126.

The back layer 126 also is preferably formed of a substantially inelastic material such as, for example, natural leather, synthetic leather, other non-woven materials, natural fabric, and synthetic fabric, among others as discussed above. Suitable leather materials include, for example, sheepskin, deerskin, doeskin, steer hide, goatskin, and kangaroo skin, among others. In one preferred embodiment, cabretta leather is used to form the back layer 126. Suitable non-woven materials include nylon, nylon-acrylic, neoprene, or terrycloth, among others. The back layer 126 can further contain sections made of elastic material to provide stretch in various directions. For example, as shown, elastic material may be disposed adjacent the knuckle region 165 of the hand and adjacent the thumb region to provide flexibility to these areas. The elastic material stretches across at least one knuckle and joint to provide flexibility. One example of a suitable elastic material that can be used in the glove is Lycra® spandex, available from DuPont.

Figure 4:
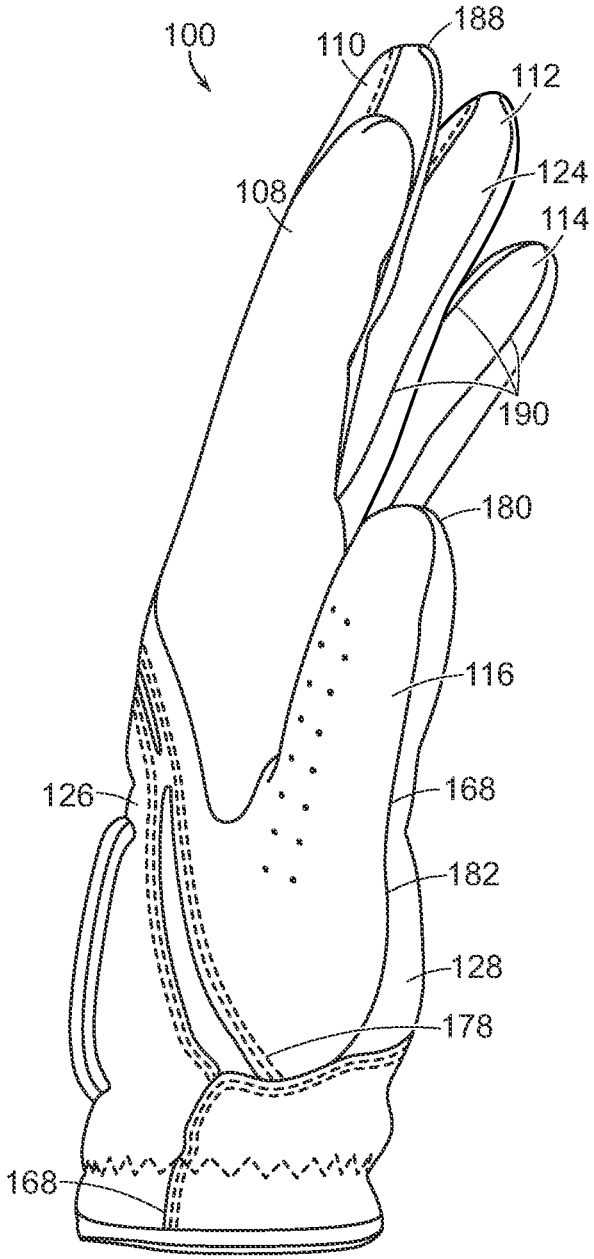
FIG. 4 is a thumb side view of the glove shown in FIG. 1.
Figure 5:
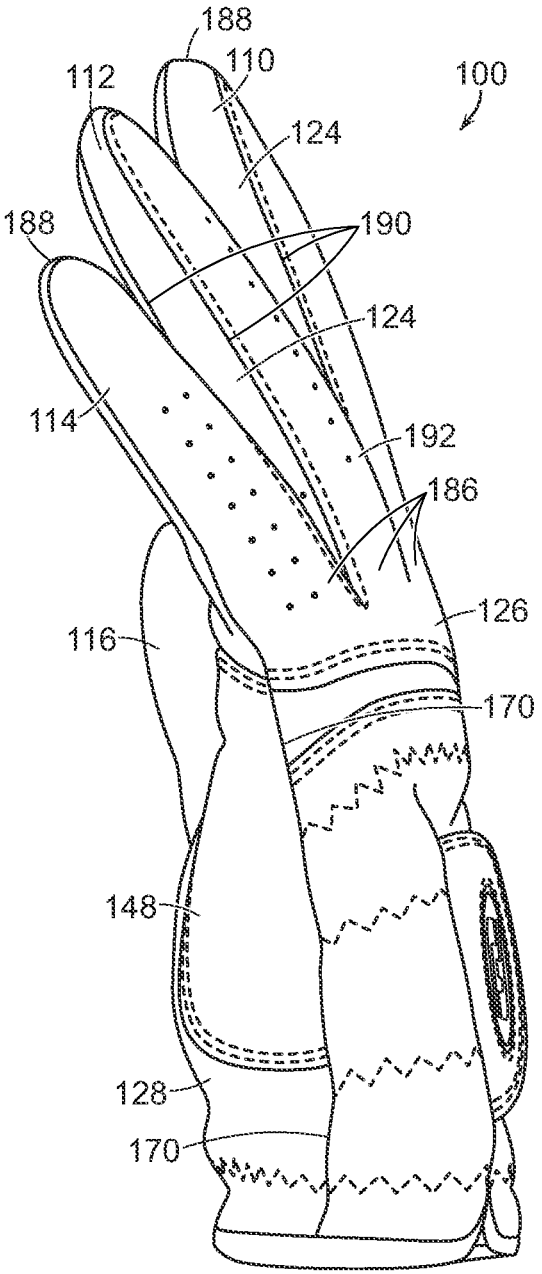
FIG. 5 is a small-finger side view of the glove shown in FIG. 1.

Referring now to FIGS. 4 and 5, the glove 100 includes a lateral side 168 (that is, the side farthest away from the body) and medial side 170 (that is, the side closest to the body). In FIG. 4, the back and front layers 126, 128 are shown attached to each other along medial side 170 stitch line. In FIG. 5, the back and front layers 126, 128 are shown attached to each other along lateral side 168 stitch line. In some versions, however, it will be appreciated that one of the lateral and medial stitch lines may not be present. For example, the front layer 128 of the glove may simply wrap continuously around the lateral side 168 to the back layer 126. The lateral side 168 also can be referred to as radial side, and the medial side 170 can be referred to as the ulnar side, the radius and ulna being the two long bones in the forearm. When the arms are let down at the sides of the body and the palms of the hands face forward, the ulna is located at the side of the forearm closest to the body (medial side).

In FIG. 1, the thumb stall 116 is shown having a proximal end 178 and a distal end 180. A stitch line 182 extends along the thumb stall 116 to join the back and front layers of the thumb stall 116. The thumb stall 116 is attached to the palm portion 138 of the front layer 128 along an stitch line 184. Each finger stall 108, 110, 112, 114 also includes base or proximal ends 186 and tip or distal ends 188. Stitch lines 190 also extend down the sides of the finger stalls 108, 110, 112 and 114 to join the back and front layers 126, 128 of the glove 100 along the fingers with the at least one gusset portion 130 between.

Figure 6:
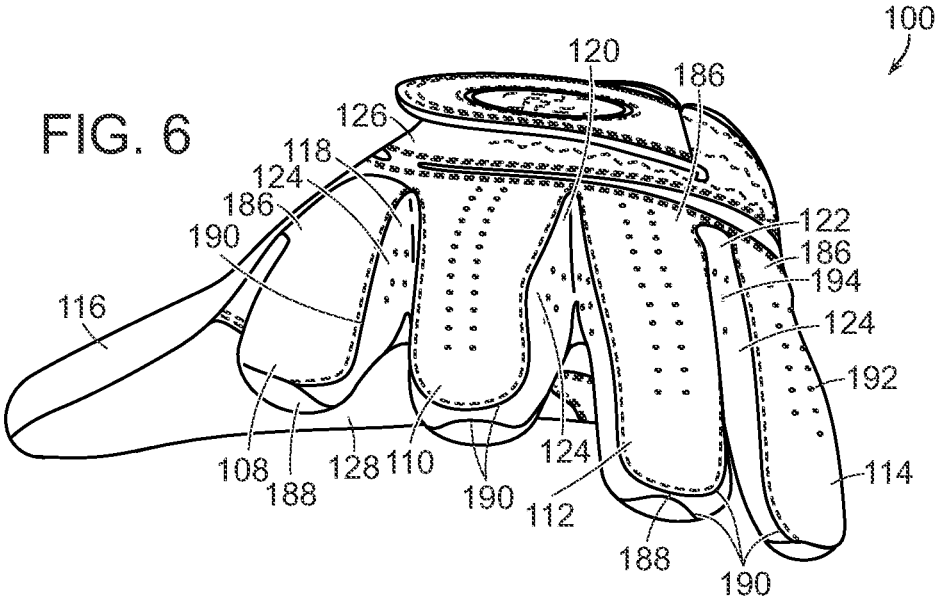
FIG. 6 is an end view of the closed finger-tip end of the glove shown in FIG. 1.

In FIGS. 1, 2 and 6, the back layer 126 and gussets 118, 120, 122 of the glove are shown containing perforations 192, 194. Perforations may be used for ventilation. As shown, the back layer 126 may contain perforations 192 on the finger stalls 108, 110, 112, 114. The front layer 128 is shown without perforations, although it will be appreciated that perforations may be provided on the front layer. The glove may have various designs and patterns, and it is not required that the back layer 126 contain perforations. A wide variety of back layer 126 constructions, patterns, and designs may be used in the glove constructions of this invention. It should be understood that the back and front layers 126, 128 shown in FIGS. 1-6 are for illustrative purposes only and not meant to be restrictive. Other perforation patterns and glove constructions may be made in accordance with the present invention. It will be appreciated that in conventional manufacturing methods used for producing glove perforations, sheet material is fed between rollers and long, pointed needles puncture the material. Then, the perforated material is cut into various sections for assembling the glove. The glove is then assembled.

Figure 7:
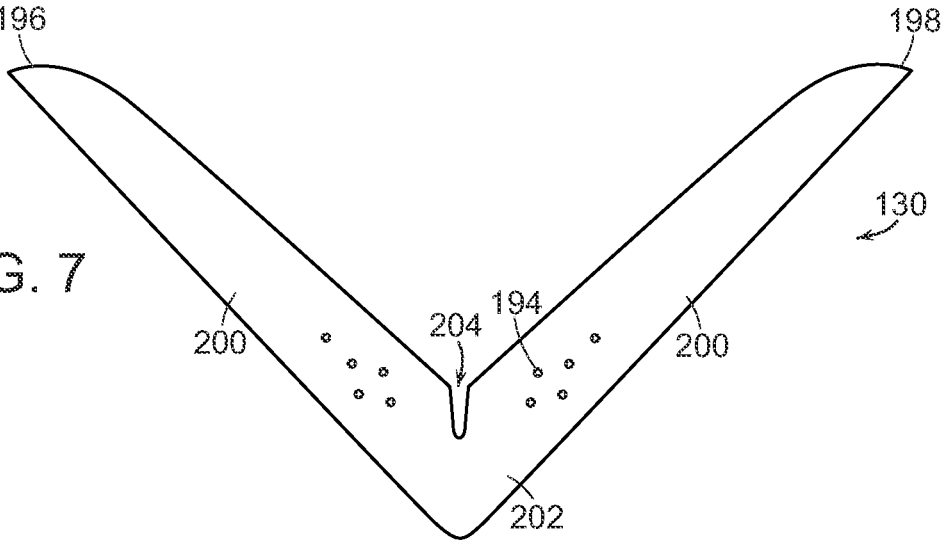
FIG. 7 is a plan view of a piece forming a gusset prior to sewing into the glove of FIG. 1.
Figure 8:
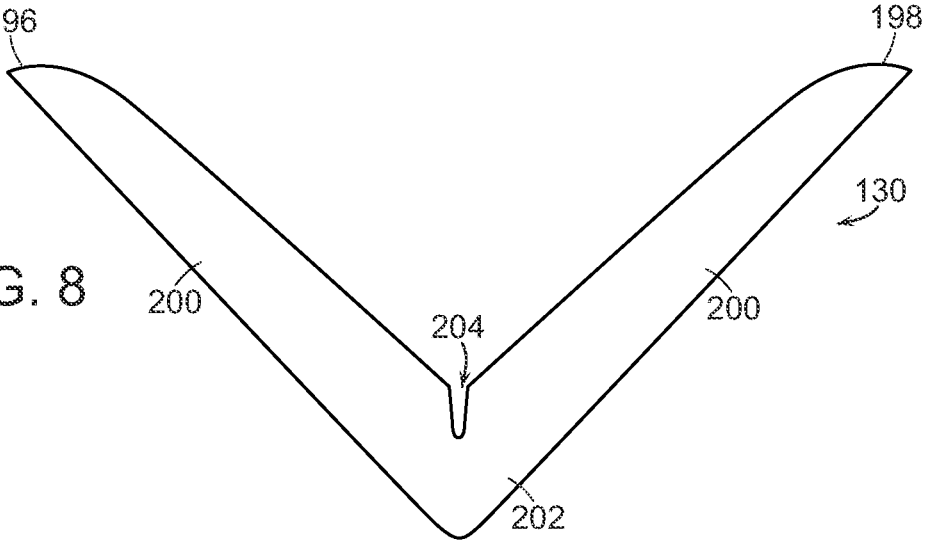
FIG. 8 is a plan view of another embodiment of the piece forming a gusset prior to sewing into the glove of FIG. 1.

The glove of the present invention is designed to fit snugly on a wearer's hand without sacrificing a nice feel. The glove is skintight and yet it remains comfortable. As shown in FIG. 7, the gusset portion 130 may be a piece that is provided between the finger stalls. For example, the gusset portion 130 shown in FIG. 7 has a first and second ends 196, 198, two side portions 200 and a valley portion 202. The first end 198 is joined to the distal end or tip 188 of one finger stall, side portion 200 forms the inner side 124, into the valley portion 202 adjacent the base 186 of the finger stalls and side portion 200 form the inner side 124 of the adjacent finger stall where the second end 198 is joined to the distal end or tip 188 of the adjacent finger stall. This enables the valley portion 202 between the base or proximal end 186 of the finger stalls to not have a seam. Thus, the valley portion 202 is rendered seamless and thereby improving the feel and comfort of the glove for the golfer and making manufacturing of the glove easier as it requires less seams for sewing during assembly. Notch 204 forms a gap in the valley portion 202 adjacent the palm portion of the front layer. As shown in FIG. 7, the gusset portion 130 may include perforations 194. It will be appreciated that the perforations 194 may be provided in any number and pattern on the gusset portion 130 to provide ventilation on the finger stall. FIG. 8 shows a construction of the gusset portion 130 similar to FIG. 7 without the perforations being provided. It will be appreciated that the gusset portions 130 of FIGS. 7 and 8 require three separate gusset portions 130 to be provided to form the finger stalls 108, 110, 112, 114 with the back and front layers 126, 128. Moreover, it will be appreciated that preferably the index finger stall 108 is formed solely with the front layer 128 as it wraps around the index finger and connects on both sides to the gusset portion 130 to form the index finger stall 108. This eliminates any outer seam on the index finger stall 108, thereby providing a more comfortable fit and making manufacturing easier.

Figure 9:
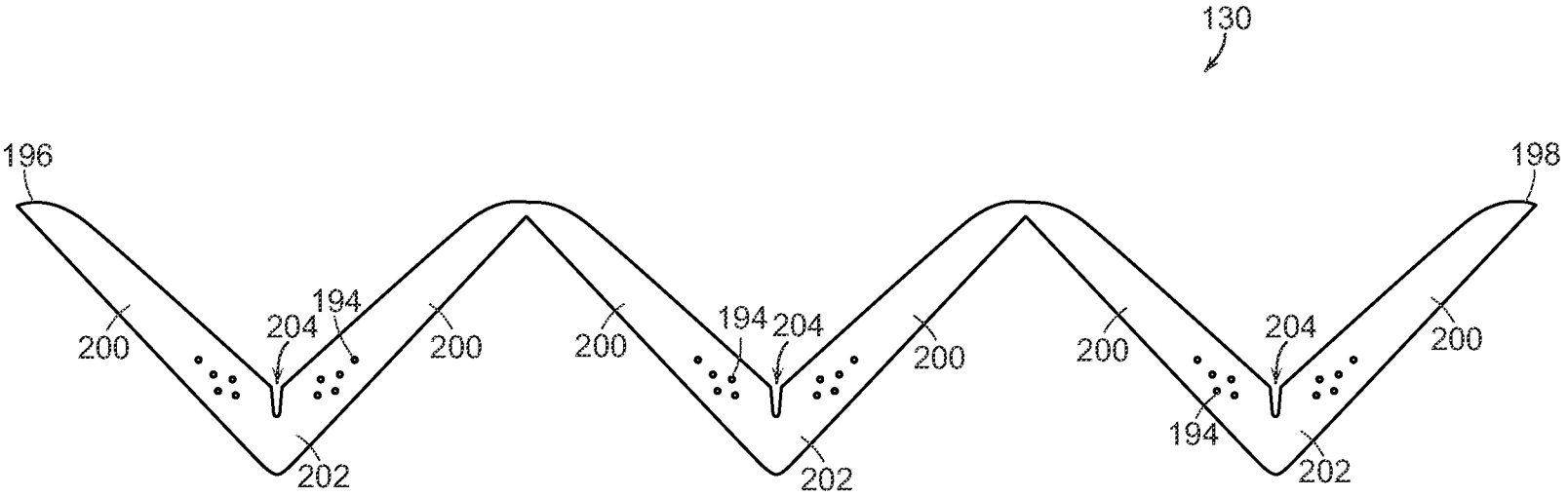
FIG. 9 is a plan view of another embodiment of the piece forming the gussets prior to sewing into the glove of FIG. 1.

Referring to FIG. 9, it will be appreciated that the gusset portion 130 may be formed as a single piece that forms the inner sides 124 of each finger stall 108, 110, 112, 114 and the three valley portions 202 provided between the finger stalls. The gusset portion 130 features first and second ends 196, 198, six side portions 200 to form the inner sides 124 of the finger stalls, three valley portions 202 to form a base between adjacent finger stalls and three notches 204 provided in the valley portions 202. Two mid-points 206 of the gusset portion 130 are located where the gusset portion 130 is provided at the distal end or tip 188 of the middle and ring finger stalls 110, 112. As shown, the inner sides 124 of the finger stalls may feature perforations 194 for ventilation, although it will be appreciated that the perforations are not required as previously described. Providing the gusset portion 130 as one single piece of material to form the three gussets 118, 120, 122 on the glove further eliminates the need to sew three separate pieces into the glove for forming the finger stalls 108, 110, 112, 114, thus further easing manufacturing time and expense.

Figure 10:
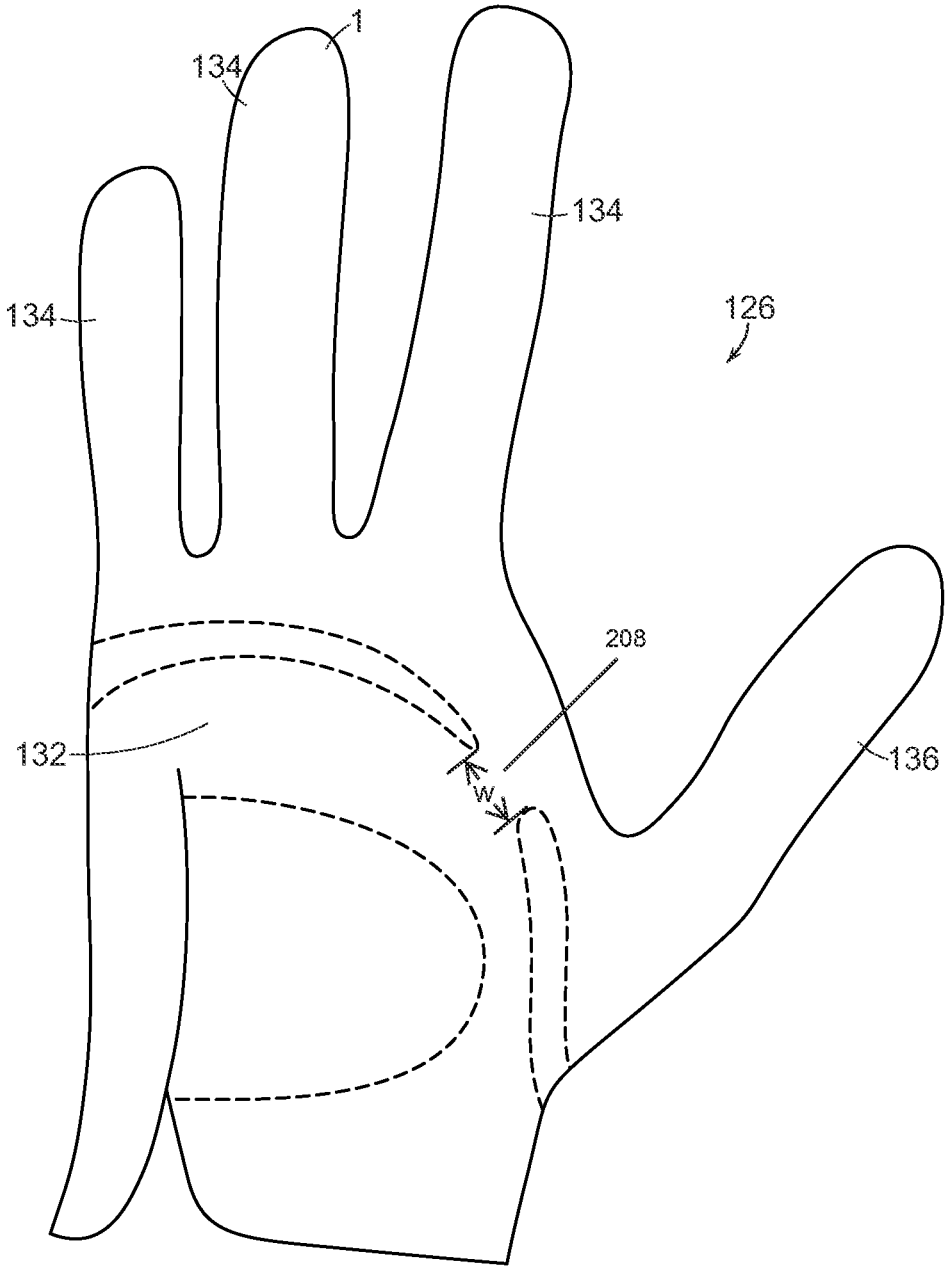
FIG. 10 is a plan view of the piece forming the back of the glove of FIG. 1 prior to sewing into the glove.
Figure 11:
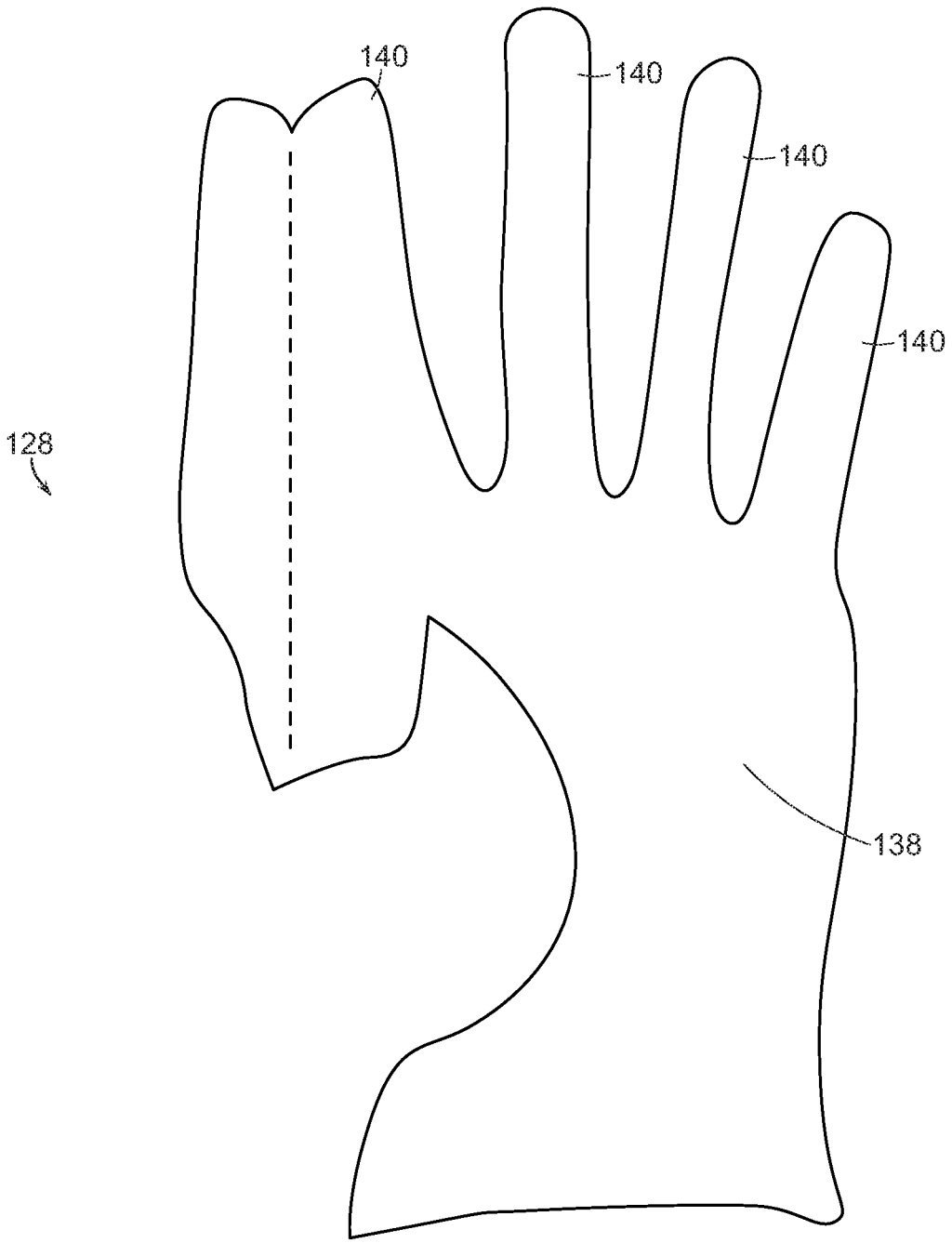
FIG. 11 is a plan view of the piece forming the palm of the glove of FIG. 1 prior to sewing into the glove.

Referring now to FIGS. 10 and 11, the back layer 126 and front layer 128 are shown separately prior to assembly. It will be appreciated that the back layer 126 is used to form the back portion 132 of the glove 100 along with the back finger portions 134 of the middle, ring and small finger stalls 110, 112, 114 and the back thumb portion 136 of the thumb stall 116. As shown in FIG. 11, the front layer 128 forms the palm portion 138 of the glove 100 along with the front finger portions 140 of the index, middle, ring and small finger stalls 108, 110, 112 and 114 and the front thumb portion 142 (see FIG. 3) of the thumb stall 116 (see FIG. 3). Additionally, the front layer 128 wraps to form the index finger stall 108, thus joining the back layer 126 at the base of the index finger stall 108 and eliminating an outer seam along the index finger stall.

Figure 13:
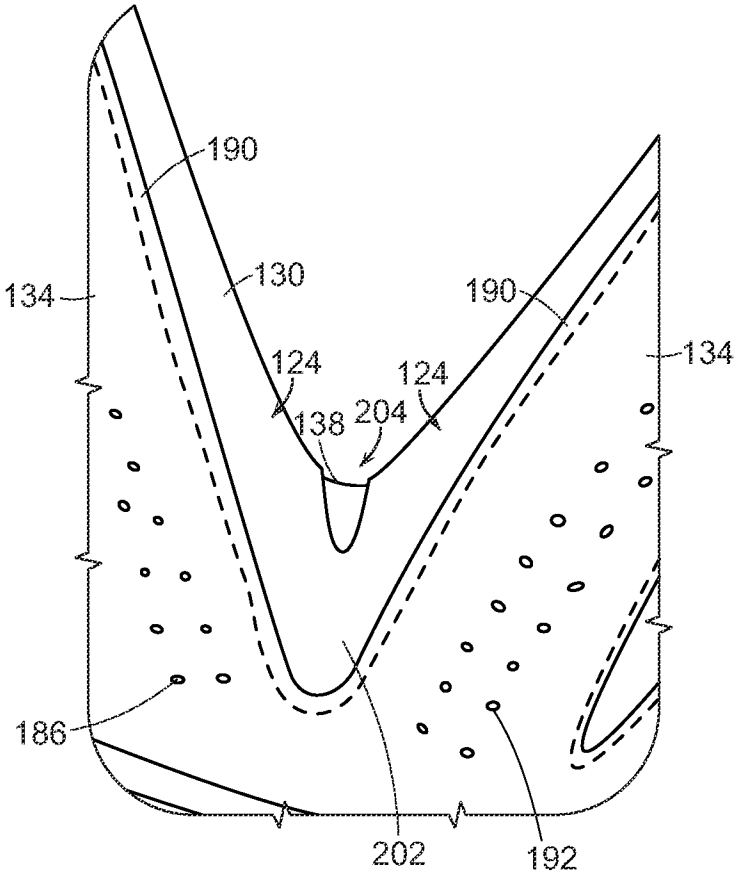
FIG. 13 is a detailed view showing another embodiment of the seamless gusset of the present invention.
Figure 12:
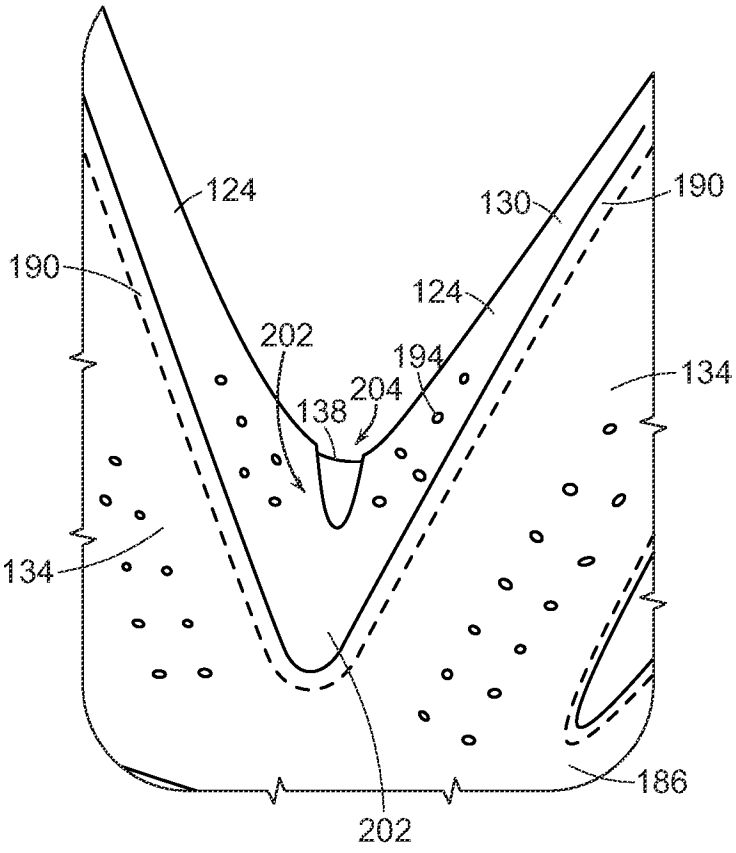
FIG. 12 is a detailed view showing the seamless gusset of the present invention.
Figure 14:
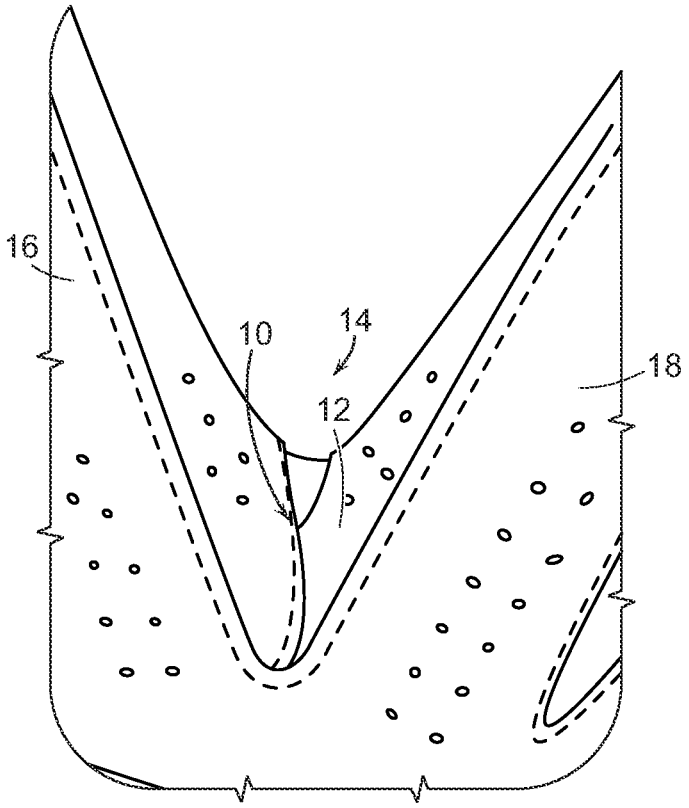
(PRIOR ART) FIG. 14
FIG. 14 is a is a detailed view showing a gusset of the prior art.

Referring now to FIGS. 12 and 13, the gusset 118, 120, 122 between finger stalls 108, 110, 112, 114 is shown. The valley portion 202 between adjacent finger stalls is shown in detail (either with or without perforations on the sides of the finger stalls) formed by the gusset portion 130. It will be appreciated that there is no seam in the valley portion 202 between the finger stalls. The notch 204 of the gusset portion 130 forms a gap between the valley portion 202 and the palm portion 138 of the front layer 128. The elimination of the valley seam makes for a more comfortable glove according to the present construction. The elimination of this seam also reduces the steps required to assemble the glove, thus making manufacture of the golf glove easier.

Referring now to FIGS. 1 and 10, bridge 208 joins the back finger portions 134 of the finger stalls 110, 112, 114 of the back layer 126 with the back portion 132 to reduce over stretching of the elastic material in the knuckle region 165. The bridge 208 is preferably located adjacent to the forefinger stall 108, although it will be appreciated that the bridge 208 could be located adjacent to any of the fingerstalls 108, 110, 112, 114 crossing over the knuckle region 165. Additionally, one or more bridges 208 could be provided connecting the back portion 132 to the back finger portions 134 of the back layer 126. The bridge has a width w of about 2 mm to 40 mm, preferably about 4 mm to 30 mm, and more preferably about 6 mm to about 20 mm. Preferably, the bridge is formed of an inelastic material as described above. More preferably, the back portion 132, bridge 208 and the back finger portions 134 are formed as one piece of inelastic material. The inelastic bridge 208 segments the elastic knuckle region 165 into at least two portions and allows four-way stretch of the elastic knuckle region 165, but with a firmness that prevents over stretching of this region over the knuckles to the thumb. Thus, the glove provides a proper snug fit to the golfer such that is skintight and yet remains comfortable.

It should be understood the golf glove 100 shown in FIGS. 1-13 are for illustrative purposes only and not meant to be restrictive. Other golf glove constructions may be made in accordance with this invention.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention.

It is understood that the golf gloves described and illustrated herein represent only some embodiments of the invention. It is appreciated by those skilled in the art that various changes and additions can be made to compositions and products without departing from the spirit and scope of this invention. It is intended that all such embodiments be covered by the appended claims.

We claim:

1. A golf glove, comprising:

a body comprising a back layer and front layer and at least one gusset portion, the back layer and the front layer being joined together to define a cavity for receiving a wearer's hand, the body including an open end for inserting the wearer's hand and a closed end having multiple finger stalls and a thumb stall for receiving fingers and thumb respectively of the wearer's hand;

a back portion and back finger portions provided on the back layer;

at least one section of substantially elastic material provided in the back layer between the back portion and back finger portions, the elastic material stretching across at least one knuckle region;

a bridge provided connecting the back portion and the back finger portions, the bridge being formed of a substantially inelastic material to reduce over stretching of the elastic material over the at least one knuckle region, the bridge segmenting the at least one section of substantially elastic material into at least two portions.

2. The golf glove of claim 1, wherein the front layer is formed of a substantially inelastic material.

3. The golf glove of claim 2, wherein the inelastic material is natural leather or synthetic leather.

4. The golf glove of claim 1, wherein the back portion and back finger portions are formed of a substantially inelastic material.

5. The golf glove of claim 4, wherein the inelastic material natural leather or synthetic leather.

6. The golf glove of claim 4, wherein the bridge is made of the same material as the back portion and back finger portions.

7. The golf glove of claim 4, wherein the bridge, the back portion and the back finger portions are one piece of inelastic material.

8. The golf glove of claim 1, wherein the bridge is provided adjacent to an index finger stall of the glove.

9. The golf glove of claim 1, wherein the bridge has a width of about 2 mm to 40 mm.

10. The golf glove of claim 9, wherein the bridge has a width of about 4 mm to 30 mm.

11. The golf glove of claim 10, wherein the bridge has a width of about 6 mm to 20 mm.

12. The golf glove of claim 1, wherein the at least one gusset portion extends continuously between at least a tip of one finger stall to a tip of an adjacent finger stall, thereby forming inner sides of the finger stalls by extending through a valley between the adjacent finger stalls such that the valley does not contain a seam.

13. The golf glove of claim 12, wherein the front layer forms a front and a back of an index finger stall.

14. The golf glove of claim 12, wherein a notch in the gusset portion is provided in the valley adjacent the front layer.

15. The golf glove of claim 12, wherein the gusset is a single piece of material forming the inner sides of an index, middle, ring and small finger stalls and the valleys therebetween.

16. The golf glove of claim 12, further comprising three gussets wherein the three gussets are each formed of a separate piece of material forming the inner sides between adjacent finger stalls.

17. The golf glove of claim 8, wherein the inelastic bridge allows four-way stretch of the elastic knuckle region and prevents over stretching of this region over the knuckles to the thumb.

* * * * *